US011667984B2

(12) United States Patent
Joo et al.

(10) Patent No.: US 11,667,984 B2
(45) Date of Patent: Jun. 6, 2023

(54) GRAIN-ORIENTED ELECTRICAL STEEL SHEET AND MANUFACTURING METHOD THEREFOR

(71) Applicant: POSCO, Pohang-si (KR)

(72) Inventors: Hyung Don Joo, Pohang-si (KR); Min Soo Han, Pohang-si (KR); Hyung Ki Park, Pohang-si (KR); Sang Woo Lee, Pohang-si (KR); Jin-Wook Seo, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 215 days.

(21) Appl. No.: 16/472,480

(22) PCT Filed: Dec. 20, 2017

(86) PCT No.: PCT/KR2017/015129
§ 371 (c)(1),
(2) Date: Jun. 21, 2019

(87) PCT Pub. No.: WO2018/117642
PCT Pub. Date: Jun. 28, 2018

(65) Prior Publication Data

US 2021/0130918 A1 May 6, 2021

(30) Foreign Application Priority Data

Dec. 22, 2016 (KR) ..... 10-2016-0177014

(51) Int. Cl.

| | |
|---|---|
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/18*** | (2006.01) |
| ***C22C 38/60*** | (2006.01) |
| ***C21D 8/12*** | (2006.01) |

(52) U.S. Cl.
CPC ..... *C21D 8/1222* (2013.01); *C21D 8/1205* (2013.01); *C21D 8/1233* (2013.01); *C21D 8/1272* (2013.01); *C21D 9/46* (2013.01); *C22C 38/001* (2013.01); *C22C 38/002* (2013.01); *C22C 38/004* (2013.01); *C22C 38/008* (2013.01); *C22C 38/02* (2013.01); *C22C 38/04* (2013.01); *C22C 38/06* (2013.01); *C22C 38/18* (2013.01); *C22C 38/60* (2013.01)

(58) Field of Classification Search
CPC .. C21D 8/1222; C21D 8/1205; C21D 8/1233; C21D 8/1272; C21D 9/46; C22C 38/004
See application file for complete search history.

(56) References Cited

U.S. PATENT DOCUMENTS 4,543,134 A 9/1985 Tanaka et al.

FOREIGN PATENT DOCUMENTS

| | | | | |
|---|---|---|---|---|
| CN | 1141348 | A | | 1/1997 |
| CN | 104884644 | A | | 9/2015 |
| JP | S62-040704 | A | | 2/1987 |
| JP | H02-209426 | A | | 8/1990 |
| JP | H06-063036 | B2 | | 8/1994 |
| JP | H06-212264 | A | | 8/1994 |
| JP | H06-256848 | A | | 9/1994 |
| JP | H07-027867 | A | | 1/1995 |
| JP | H07-173642 | A | | 7/1995 |
| JP | H07-233418 | A | | 9/1995 |
| JP | H11-043746 | A | | 2/1999 |
| JP | 11335794 | A | * | 12/1999 |
| JP | H11-335794 | A | | 12/1999 |
| JP | 2000-104143 | A | | 4/2000 |
| JP | 2001-158950 | A | | 6/2001 |
| JP | 2003-247024 | A | | 9/2003 |
| JP | 2003-268450 | A | | 9/2003 |
| JP | 2006-299297 | A | | 11/2006 |
| JP | 2008-196016 | A | | 8/2008 |
| KR | 10-2015-0073551 | A | | 7/2015 |
| KR | 10-1633255 | B1 | | 7/2016 |
| KR | 10-1651797 | B1 | | 8/2016 |

OTHER PUBLICATIONS

JP-11335794-A, Muraki Mineo; Okabe Seiji; Yamaguchi Hiroshi, English Translation obtained from EPO, 1999 (Year: 1999).*
Structures and magnetic properties of Grain-oriented 3.2% silicon-iron, M. F. Littmann, Journal of Applied Physics, vol. 38, No. 3, 1104-1108, 1967 (Year: 1967).*
Japanese Office Action dated Jul. 7, 2020 issued in Japanese Patent Application No. 2019-534128.
Chinese Search Report dated Jul. 23, 2020 issued in Chinese Patent Application No. 2017800802220.
European Office Action dated Aug. 13, 2020 issued in European Patent Application No. 17884744.8.
International Search Report dated Apr. 5, 2018 issued in International Patent Application No. PCT/KR2017/015129 (with English translation).
Y. Ushigami, et al., "Recent development of low-loss grain-oriented silicon steel," Journal of Magnetism and Magnetic Materials, No. 254-255, 2003, pp. 307-314.

* cited by examiner

*Primary Examiner* — Anthony J Zimmer
*Assistant Examiner* — Jacob J Gusewelle
(74) *Attorney, Agent, or Firm* — Morgan, Lewis & Bockius LLP

(57) ABSTRACT

A grain-oriented electrical steel sheet according to an embodiment of the present includes Si at 1.0 wt % to 7.0 wt %, C at 0.005 wt % or less (excluding 0 wt %), In at 0.001 wt % to 0.5 wt %, and the remainder including Fe and other impurities unavoidably added thereto.

6 Claims, No Drawings

GRAIN-ORIENTED ELECTRICAL STEEL SHEET AND MANUFACTURING METHOD THEREFOR

CROSS-REFERENCE OF RELATED APPLICATIONS

This application is the U.S. National Phase under 35 U.S.C. § 371 of International Patent Application No. PCT/KR2017/015129, filed on Dec. 20, 2017, which in turn claims the benefit of Korean Patent Application No. 10-2016-0177014, filed Dec. 22, 2016, the entire disclosures of which applications are incorporated by reference herein.

TECHNICAL FIELD

The present invention relates to a grain-oriented electrical steel sheet and a manufacturing method therefor. More particularly, the present invention relates to a grain-oriented electrical steel sheet including a mirroring-surface element and a manufacturing method therefor.

BACKGROUND ART

A grain-oriented electrical steel sheet refers to an electrical steel sheet containing a Si component in a steel sheet, and having a texture of a grain orientation aligned in a {110}<001> direction. It is mainly used as an iron core of a transformer, an electric motor, a generator, other electronic devices, and the like, and has excellent magnetic properties in a rolling direction.

Recently, as a grain-oriented electrical steel sheet of a high magnetic flux density have been commercialized, a material having less core loss has been required. This may be approached by the following four main technical methods: i) accurately orienting a {110}<001> grain orientation including an easy magnetization axis of a grain-oriented electrical steel sheet in a rolling direction; ii) rendering a material to be a thin plate; iii) refining a magnetic domain by a chemical or physical process; and iv) improving surface physical properties or imparting surface tension by a chemical process such as surface treating.

The iv) method described above is to improve magnetism of a material by actively improving surface properties of the grain-oriented electrical steel sheet. As a representative example thereof, a method of removing a base coating layer produced through chemical reaction with components of an oxide layer and an annealing separating agent inevitably produced in a process of decarbonizing-annealing, may be provided.

As a technology that removes the base coating layer, a method of forcibly removing a common product in which the base coating layer is already formed with sulfuric acid or hydrochloric acid and a technology (hereinafter, a glassless/glassless technology) removing or suppressing the base coating layer in a process in which the base coating layer is formed has been proposed.

Up to now, the primary research of the glassless technology has proceeded in two directions of a technology using a surface etching effect in a high temperature annealing process after adding chlorides to an annealing separating agent, and a technology not forming the base coating layer itself in a high temperature annealing process after coating an $Al_2O_3$ powder as the annealing separating agent.

The ultimate object of these technologies is to remove a surface pinning site causing the magnetism deterioration and to ultimately improve the magnetism of the oriented electrical steel sheet, by intentionally preventing formation of the base coating layer in the manufacturing of the electrical steel sheet.

As described above, the two proposed glassless methods, that is, both the method of suppressing the formation of the base coating layer and the technology of separating the base coating layer from a mother material in a high temperature annealing process, have a problem in a process in which an oxidation capacity ($PH_2O/PH_2$) in a furnace must be controlled to be very low through hydrogen gas, nitrogen gas, and a dew point change during the decarbonizing-annealing process. The reason for controlling the oxidation capacity to be low is to maximally suppress the formation of the base coating layer by minimizing the oxidation layer formed on the surface of the mother material surface during the decarburization process, and also the oxidation layer produced when the oxidation capacity is low in the furnace is mostly composed of silica ($SiO_2$) such that the iron-based oxide production may be suppressed, thereby there is a merit that the iron-based oxide does not remain on the surface after high temperature annealing. However, in such a case, because it is difficult to secure an appropriate primary recrystallization grain size due to decarburization failure and a problem may also occur in secondary recrystallization grain growth during high temperature annealing, the decarburization process must be longer than the processing process of the common material in order to thin the oxidation layer while properly securing the decarburization characteristic, thereby productivity is deteriorated.

In the manufacturing of the low core loss grain-oriented electrical steel sheet through the conventional glassless technology, an inhibitor existing in the steel is abruptly diffused to the surface side and disappears due to the thin oxidation layer during high temperature annealing such that there is a problem that the secondary recrystallization is unstable, and thus, as a method solving this problem, a technique in which a sequence pattern controlling the atmosphere during the high temperature annealing and slowing a temperature raising rate in a temperature raising period is applied to suppress the inhibitor in the steel from being diffused to the surface side, has been proposed.

In addition, in the method of controlling the conventional oxidation capacity to be low to maximally suppress the formation of the base coating layer by minimizing the formation of the oxidation layer, when performing a heat treatment in a coil shape during the high temperature annealing, different dew points and temperature movements occur depending on a position of the sheet in the coil during the high temperature annealing, and in this case, there is a difference in the formation of the base coating layer, which causes a glassless degree difference according thereto, and it may become a big problem in mass production because of sheet partial deviation generation.

Therefore, in order to manufacture the low core loss grain-oriented electrical steel sheet through the current glassless method, it is difficult to avoid the productivity deterioration in the decarburization process and high temperature annealing, and it is difficult to avoid deviation in the width direction and the longitudinal direction because the high temperature annealing process is performed in a batch annealing manner, thus it is difficult to avoid a decrease in an actual yield.

In addition, a method in which an additive such as a chloride is added to the annealing separating agent, and while the high temperature annealing is performed, the base material adjacent to the surface oxide layer by a discharged hydrochloric acid is $FeCl_2$ steam to be stripped, is proposed.

However, coil annealing is required due to the necessity of high-temperature heat treatment, and thus a temperature variation occurs in the coil when the temperature is raised. In this case, when the moisture contained in the annealing separating agent becomes hot, respective positions of the coil are differently affected such that the surface oxide layer for respective positions differently is affected, and since the formation of the base coating layer or the stripping of the base coating layer are differently affected, even if a good condition for forming the mirror surface by the additive in the annealing separating agent is found, it is difficult to make all the positions of the coil the same, thus it is in principle and structurally difficult to uniformly form the mirroring surface in the entire coil.

DISCLOSURE

The present invention has been made in an effort to provide a manufacturing method of a grain-oriented electrical steel sheet and a grain-oriented electrical steel sheet manufactured by the method. More particularly, the present invention relates to a grain-oriented electrical steel sheet including a mirroring-surface element and a manufacturing method therefor.

An embodiment of the present invention provides a grain-oriented electrical steel sheet, including: Si at 1.0 wt % to 7.0 wt %, C at 0.005 wt % or less (excluding 0 wt %), In at 0.001 wt % to 0.5 wt %, and the remainder including Fe and other impurities unavoidably added thereto.

Mn at 0.005 wt % to 0.9 wt %, Al at 0.01 wt % to 0.1 wt %, N at 0.015 wt % to 0.05 wt %, and S at 0.03 wt % or less (excluding 0 wt %) may be further included.

At least one of Sb at 0.005 wt % to 0.15 wt % and Sn at 0.005 wt % to 0.2 wt % may be further included.

At least one of P at 0.005 wt % to 0.075 wt % and Cr at 0.005 wt % to 0.35 wt may be further included.

An area ratio of grains having a particle diameter of 1 mm or less may be 10% or less.

A surface roughness (Ra) may be 0.8 μm or less.

An embodiment of the present invention provides a manufacturing method of a grain-oriented electrical steel sheet, including: providing a slab including Si at 1.0 wt % to 7.0 wt %, Cat 0.005 to 0.10 wt %, In at 0.001 wt % to 0.5 wt %, and the remainder including Fe and other impurities unavoidably added thereto; heating the slab; hot-rolling the slab to produce a hot-rolled steel sheet; cold-rolling the hot-rolled steel sheet to produce a cold-rolled steel sheet; primary recrystallization-annealing the cold-rolled steel sheet; and secondary recrystallization-annealing the steel sheet after completion of the primary recrystallization-annealing.

The slab may further include Mn at 0.005 wt % to 0.9 wt %, Al at 0.01 wt % to 0.1 wt %, N at 0.02 wt % or less (excluding 0 wt %), and S at 0.03 wt % or less (excluding 0 wt %).

The slab may further include at least one of Sb at 0.005 wt % to 0.15 wt % and Sn at 0.005 wt % to 0.2 wt %.

The slab may further include at least one of P at 0.005 wt % to 0.075 wt % and Cr at 0.005 wt % to 0.35 wt %.

In the secondary recrystallization-annealing, an annealing separating agent may be applied to the steel sheet after completion of the primary recrystallization-annealing, and the secondary recrystallization-annealing may be performed.

The annealing separating agent may include MgO or $Al_2O_3$ as a solid content.

The manufacturing method of the grain-oriented electrical steel sheet may further include removing a base coating layer formed on a surface of the steel sheet after the secondary recrystallization-annealing.

The steel sheet after completion of the primary recrystallization annealing may contain N at 0.015 wt % to 0.05 wt %.

The secondary recrystallization-annealing includes heating and cracking, and the cracking is performed at a temperature of 900 to 1250° C.

According to the embodiment of the present invention, it is possible to improve the magnetic property by forming a surface as smooth as a mirror surface to easily move a magnetic domain without controlling a kind and characteristics of a specific annealing separating agent or without adding a specific additive to the annealing separating agent.

A grain-oriented electrical steel sheet from which a base coating layer is eliminated may eliminate a main factor limiting movement of a magnetic domain, thus it is possible to improve iron loss of the grain-oriented electrical steel sheet and to prevent deterioration of workability due to the base coating layer.

MODE FOR INVENTION

It will be understood that, although the terms first, second, third, etc. may be used herein to describe various elements, components, regions, layers, and/or sections, they are not limited thereto. These terms are only used to distinguish one element, component, region, layer, or section from another element, component, region, layer, or section. Therefore, a first part, component, area, layer, or section to be described below may be referred to as second part, component, area, layer, or section within the range of the present invention.

The technical terms used herein are to simply mention a particular embodiment and are not meant to limit the present invention. An expression used in the singular encompasses the expression of the plural, unless it has a clearly different meaning in the context. In the specification, it is to be understood that the terms such as "including", "having", etc., are intended to indicate the existence of specific features, regions, numbers, stages, operations, elements, components, and/or combinations thereof disclosed in the specification, and are not intended to preclude the possibility that one or more other features, regions, numbers, stages, operations, elements, components, and/or combinations thereof may exist or may be added.

When referring to a part as being "on" or "above" another part, it may be positioned directly on or above another part, or another part may be interposed therebetween. In contrast, when referring to a part being "directly above" another part, no other part is interposed therebetween.

Unless otherwise defined, all terms used herein, including technical or scientific terms, have the same meanings as those generally understood by those with ordinary knowledge in the field of art to which the present invention belongs. Terms defined in commonly used dictionaries are further interpreted as having meanings consistent with the relevant technical literature and the present disclosure, and are not to be construed as idealized or very formal meanings unless defined otherwise.

Unless otherwise stated, % means % by weight, and 1 ppm is 0.0001% by weight. In addition, Goss grains are grains having a crystal orientation within 15 degrees from {110}<001>.

Further, in exemplary embodiments of the present invention, inclusion of an additional element means replacing the remaining iron (Fe) by an additional amount of the additional elements.

The present invention will be described more fully hereinafter, in which exemplary embodiments of the invention are shown. As those skilled in the art would realize, the described embodiments may be modified in various different ways, all without departing from the spirit or scope of the present invention.

The present invention provides a method for adding a specific component in a grain-oriented electrical steel sheet to cause the component to segregate at an interface between a metal substrate layer and a base coating layer and to cause stripping of the base coating by the segregated metal material to form a mirroring surface.

A grain-oriented electrical steel sheet according to an embodiment of the present invention includes Si at 1.0 wt % to 7.0 wt %, C at 0.005 wt % or less (excluding 0 wt %), In at 0.001 wt % to 0.5 wt %, and the remainder including Fe and other impurities unavoidably added thereto. A reason of limiting the composition thereof will now be described.

Silicon (Si) is a basic composition of an electric steel sheet, and it serves to reduce core loss by increasing specific resistance of a material. When a content of Si is too small, the specific resistance is decreased to deteriorate the iron loss property, and when a content of Si is excessive, brittleness of the steel becomes high such that cold-rolling becomes difficult. The content of Si in the present invention is not limited to that contained in a slab. It is not out of the scope of the present invention to contain Si within the above-mentioned range in a final steel sheet by being prepared by a diffusion method after powder coating or surface deposition. Therefore, Si at 1.0 wt % to 7.0 wt % may be contained. Specifically Si at 2.0 wt % to 4.5 wt % may be contained.

Carbon (C) is required in the manufacturing process but serves as a detrimental material in a final product. As an austenite stabilizing element during the manufacturing process, it refines a coarse columnar structure occurring during a soft casting process by causing a phase change at a temperature of 900° C. or higher and suppresses slab center segregation of sulfur. It also promotes work-hardening of the steel sheet during cold-rolling, thereby promoting the formation of secondary recrystallization nuclei in the {110}<001> orientation in the steel sheet. Therefore, although there is no great restriction on an added amount, when less than 0.005 wt % thereof is contained in the slab, the effect of the phase change and work-hardening may not be obtained, and when more than 0.10 wt % thereof is contained, since a hot-rolling edge crack occurs, there is a problem in a work and a decarburization process is burdened in decarburization annealing after cold-rolling, thus its addition amount in the slab is preferably 0.005 to 0.10 wt %.

Carbon is decarburized in the primary recrystallization annealing process, and its content is reduced to 50 ppm or less in the final produced electrical steel sheet. More preferably, it is reduced to 30 ppm or less.

Therefore, in the grain-oriented electrical steel sheet according to the embodiment of the present invention, carbon is limited to 0.005 wt % or less. In the manufacturing method of the grain-oriented electrical steel sheet according to the embodiment of the present invention, carbon is contained in an amount of 0.005 to 0.10 wt % in the slab.

Indium (In) is an important element as a mirroring-surface element in the embodiment of the present invention. In is segregated at the interface between the metal base material and the base coating layer at a temperature at which the base coating layer is formed. In is segregated at the interface, causing a difference between the base coating layer and the metal base material. This is a phenomenon occurring in the entire steel sheet, so even if it is annealed at a high temperature in a coil form, the same segregation and separation may be caused in the entire coil, so that a uniform mirroring surface may be obtained. In is a mirroring-surface element, which has a strong segregation tendency, a low freezing point, a large difference in a coefficient of linear expansion with Fe, and a large shrinkage amount during solidification, and thus it may be suitably used as a mirroring-surface element. Ba, Y, Sn, and Sb are also good segregating elements, but they do not have other requirements and thus may not provide the effect of the mirroring-surface.

When the content of In is less than 0.001 wt %, the effect of the mirroring-surface hardly appears. When the content of In exceeds 0.5 wt %, the rolling property may be deteriorated and the rolling crack may increase. Specifically, In may be contained at an amount of 0.005 to 0.3 wt %. Specifically, In may be contained at an amount of 0.01 to 0.1 wt %.

Manganese (Mn) has an effect of improving the magnetic property as a resistivity element, but when too much is contained, it causes a phase change after secondary recrystallization and adversely affects the magnetism, thus when Mn is contained, it is limited to 0.005 to 0.9 wt %.

Aluminum (Al) finally becomes a nitride such as AlN, (Al,Si)N, (Al,Si,Mn)N, or the like ultimately to serve as an inhibitor, and when the content thereof is less than 0.01 wt %, a sufficient effect as the inhibitor may not be expected, and when too much is contained, a nitride of an Al system too coarsely precipitates and grows, thus it has an insufficient effect as an inhibitor. Therefore, when Al is further contained, its content is set at 0.01 to 0.1 wt %. More preferably, the content of Al may be 0.01 to 0.05 wt %.

When nitrogen (N) is contained in the slab at an amount exceeding 0.02 wt %, a size of a primary recrystallized grains becomes smaller and a secondary recrystallization starting temperature is lowered, and in this case, since grains of which orientation is not a {110}<001> orientation also cause secondary recrystallization, it takes much time to deteriorate magnetic properties and to remove N in a secondary crack period of a final annealing process, thus it is difficult to manufacture a grain-oriented electrical steel sheet having high productivity. Therefore, N in the slab is set at 0.02 wt % or less. More specifically, the content of N in the slab may be 0.06 wt % or less. In the embodiment of the present invention, nitriding occurs in the first recrystallization annealing process, and after the first recrystallization annealing, the content of N may be 0.015 wt % to 0.05 wt %. That is, the content of N in the final grain oriented electrical steel sheet may be 0.015 wt % to 0.05 wt %.

When too much sulfur (S) is added, a crack occurs during hot rolling, and thus, when S is required to be further contained, S is preferably contained at an amount of 0.03 wt % or less.

Antimony (Sb) and tin (Sn) are low-temperature segregated elements and have a good effect on improvement of a degree of integration as an auxiliary role of existing precipitates. At least one of Sb at 0.005 wt % to 0.15 wt % and Sn at 0.005 wt % to 0.2 wt may be included. Specifically, at least one of Sb at 0.01 wt % to 0.06 wt % and Sn at 0.02 wt % to 0.1 wt % may be further included.

Phosphorus (P) accelerates the growth of the primary recrystallized grains in the low-temperature grain-oriented electrical steel sheet, thereby raising the secondary recrystallization temperature and increasing the degree of integration of {110}<001> orientation in the final product. In addition, P reduces the iron loss of the final product by increasing the number of grains having a {110}<001> orientation in the primary recrystallization plate, and P also strongly enhances a {111}<112> texture in the primary recrystallization plate to enhance the {110}<001> integration of the final product, thereby also increasing the magnetic flux density. P also segregates in the grain boundaries to a high temperature of about 1000° C. during the secondary recrystallization-annealing, thereby retarding decomposition of precipitates and reinforcing restraining force. In order for this action of P to work properly, more than 0.005 wt % thereof is required. However, when P exceeds 0.075 wt %, a size of the primary recrystallized grains is rather reduced, which not only makes the secondary recrystallization unstable but also increases the brittleness, thus the cold-rolling property deteriorates. Therefore, when P is required to be further contained, 0.005 wt % to 0.075 wt % of P may be contained. Specifically, P may be contained at an amount of 0.0015 to 0.05 wt %.

When the grain-oriented electrical steel sheet contains Sb and P, $0.0370 \leq [P]+0.5*[Sb] \leq 0.0630$ (wherein [P] and [Sb] represent the content (wt %) of P and Sb elements, respectively) may be satisfied. When the above equation is satisfied, the iron loss and magnetic flux density of the grain-oriented electrical steel sheet may be further improved. When the content of [P]+0.5*[Sb] is controlled within the above-mentioned range, the iron loss improvement effect may be further improved. The reason is because the elements may be added together to have a synergistic effect, and because, when the synergistic effect meets the range of the equation, it is maximally discontinuous compared to other numerical ranges. Therefore, it is possible to control the respective component ranges and to control [P]+0.5*[Sb] in the above-mentioned range.

Chromium (Cr) acts to grow the primary recrystallized grains as ferrite-expanded elements, and increases the grains of the {110}<001> orientation in the primary recrystallization plate. In order for such an action of Cr to be effective, 0.005 wt % or more of Cr is required, but when too much Cr is added, a dense oxide layer is formed on a surface of the steel sheet in the simultaneous decarburization and nitriding process, thereby interfering with the nitriding. Therefore, when Cr is further contained, its content is set at 0.005 to 0.35 wt %. Specifically, Cr may be contained at an amount of 0.03 to 0.2 wt %.

Other components such as Ti and Ca react with oxygen in the steel to form oxides, thus they need to be strongly suppressed, and therefore they are preferably controlled to 0.005 wt % or less for each component.

The above-mentioned composition means a content in a base steel sheet except for a separate coating layer such as an insulating coating.

In the grain-oriented electrical steel sheet according to the embodiment of the present invention, an area ratio of grains having a grain size of 1 mm or less may be 10% or less. Due to such a structure characteristic, the grain-oriented electrical steel sheet according to the embodiment of the present invention is further improved in magnetism.

The grain-oriented electrical steel sheet according to the embodiment of the present invention may have surface roughness Ra of 0.8 μm or less. As described above, by adding an appropriate amount of In, which is a mirroring-surface element, In is segregated at an interface to cause a difference between the base coating layer and the metal base material, thereby smoothly removing the base coating layer, and as a result, the surface roughness Ra is small. As the surface roughness Ra becomes smaller, the magnetic domain is more easily moved, thus the magnetic property is further improved.

A manufacturing method of the grain-oriented electrical steel sheet according to the embodiment of the present invention includes: providing a slab including Si at 1.0 wt % to 7.0 wt %, C at 0.005 to 0.10 wt %, In at 0.001 wt % to 0.5 wt %, and the remainder including Fe and other impurities unavoidably added thereto; heating the slab; hot-rolling the slab to produce a hot-rolled steel sheet; cold-rolling the hot-rolled steel sheet to produce a cold-rolled steel sheet; primary recrystallization-annealing the cold-rolled steel sheet; and secondary recrystallization-annealing the primary recrystallization-annealed steel sheet. Hereinafter, each step will be described in detail.

In the manufacturing method of the grain-oriented electrical steel sheet according to the embodiment of the present invention, the slab including Si at 1.0 wt % to 7.0 wt %, C at 0.005 wt % to 0.10 wt %, In at 0.001 wt % to 0.5 wt %, and the remainder including Fe and other impurities unavoidably added thereto, is provided. The slab may further include Mn at 0.005 wt % to 0.9 wt %, Al at 0.01 wt % to 0.1 wt %, N at 0.02 wt % or less (excluding 0 wt %), and S at 0.03 wt % or less (excluding 0 wt %). Further, the slab may include at least one of Sb at 0.005 wt % to 0.15 wt % and Sn at 0.005 wt % to 0.2 wt %. In addition, the slab may further include at least one of P at 0.005 wt % to 0.075 wt % and Cr at 0.005 wt % to 0.35 wt %.

Regarding the composition of the slab, the reason for limiting the composition of the grain-oriented electrical steel sheet described above has been described in detail, so a repeated description thereof will be omitted. In the manufacturing process of the grain-oriented electrical steel sheet, the remaining components except C and N are substantially unchanged.

Next, the aforementioned slab is heated. The slab heating temperature may be 1000° C. to 1280° C. When the slab heating temperature increases, a manufacturing cost of the steel sheet increases, and a heating furnace may need repair due to melting a surface of the slab and a lifetime of the heating furnace may be shortened. In addition, when the slab is heated at a temperature of 1280° C. or lower, a columnar structure of the slab is prevented from being coarsely grown, thereby preventing cracks from occurring in a width direction of the plate in a subsequent hot-rolling process.

Next, the heated slab is hot-rolled to produce a hot-rolled steel sheet. According to the hot rolling, the hot-rolled steel sheet of 1.5 to 4.0 mm in thickness may be produced by the hot-rolling so as to obtain a final product thickness by applying an appropriate rolling rate in a final cold-rolling process. The hot rolling finishing temperature is set to 950° C. or lower, and the hot-rolled steel sheet may be quenched by water and wound at 600° C. or lower.

Next, the hot-rolled steel sheet is hot-rolled and annealed as necessary. It may be annealed at a temperature of 1000° C. to 1200° C.

Next, the hot-rolled steel sheet is subjected to cold-rolling to produce a cold rolled steel sheet. The cold-rolling is performed by using a plurality of cold-rolling methods including one or more times of cold-rolling or intermediate annealing by using a reverse mill or a tandem mill to produce a cold rolled steel sheet having a final product thickness. In the cold-rolling, a final thickness of 0.1 to 0.5 mm, more specifically 0.15 to 0.35 mm, may be obtained through a single milling.

Next, the cold-rolled steel sheet is subjected to primary recrystallization annealing. In this case, decarburization simultaneously occurs. The primary recrystallization annealing is maintained for at least 30 seconds at a temperature of 750□ or more so that the decarburization may occur well so that a carbon content of the steel sheet may be reduced to 0.005 wt % or less, more specifically 0.0030 wt % or less. At the same time, an oxide layer is appropriately formed on the surface of the steel sheet. In addition to the decarburization, the deformed cold-rolled structure is recrystallized and then crystallized to an appropriate size, and in this case, an annealing temperature and a cracking time may be adjusted so that the recrystallized grains may grow.

During the primary recrystallization annealing process, nitriding may occur. When the content of nitrogen is too small, the secondary recrystallization is difficult, thus when the content of nitrogen in the slab component is 150 ppm or less, the content of nitrogen becomes 150 ppm or more through the nitriding, and when a nitriding amount is too large, a nitrogen discharging port defect is formed, so that the nitriding is performed to 500 ppm or less. That is, the steel sheet on which the primary recrystallization annealing is performed contains 0.015 wt % to 0.05 wt % of N.

Next, the secondary recrystallization-annealing is performed on the steel sheet after completion of the primary recrystallization annealing. The secondary recrystallization-annealing includes a heating step and a cracking step in which the temperature is raised at an appropriate heating rate to cause the secondary recrystallization having the {110}<001> Goss orientation. The temperature at the cracking step may be 900 to 1250° C.

In the embodiment of the present invention, since the secondary recrystallization-annealing is performed in a batch form, the annealing separating agent is applied to the steel sheet subjected to the primary recrystallization annealing, and then the secondary recrystallization-annealing may be performed. In the case of the conventional glassless process, an additive such as a chloride is added to the annealing separating agent containing MgO or $Al_2O_3$ as a main component, while in the embodiment of the present invention, by including the mirroring-surface element in the steel sheet itself, it is possible to smoothly separate the base coating layer without using the additive such as a chloride. That is, the annealing separating agent may include MgO or $Al_2O_3$ as a solid content.

As described above, when the annealing separating agent is applied and the secondary recrystallization-annealing is performed, a surface oxide and the annealing separating agent react with each other to form a base coating layer. When an annealing separating agent containing MgO as a main component is applied, an oxide coating layer containing Mg in $Mg_2SiO_4$ as a main component is formed, and when an annealing separating agent containing $Al_2O_3$ as a main component is applied, an oxide coating layer containing Al as a main component is formed.

In the embodiment of the present invention, a step of removing the base coating layer may be further included. As described above, in the embodiment of the present invention, by appropriately adding In, which is a mirroring-surface element, to the steel sheet, the base coating layer may be smoothly removed, and after the base coating layer is removed, the surface roughness of the steel sheet may be reduced. As a removing method, a physical method or a chemical method may be used.

Hereinafter, examples will be described in detail. However, the following examples are illustrative of the present invention, so the present invention is not limited thereto.

Example 1

A steel slab containing Si at 3.2 wt % and C at 0.052 wt % and in which In is added as shown in Table 1 below and containing the remainder including Fe and other impurities unavoidably added thereto, was prepared. The steel slab was hot-rolled to produce a 2.6 mm thick hot-rolled steel sheet, which was annealed and pickled, and then cold-rolled to have a final thickness of 0.3 mm.

After the cold-rolled steel sheet was heated, it was maintained at 850□ for 120 seconds in a mixed atmosphere with a dew point temperature of 63 to 67□ formed by simultaneously charging 50 vol % of hydrogen and 50 vol % of nitrogen, and it was subjected to simultaneous decarburization and nitriding, wherein the carbon content was 30 ppm or less and the nitrogen content was 300 ppm.

The steel sheet was subjected to the secondary recrystallization-annealing by applying MgO as an annealing separating agent thereto. MgO was mixed with water and applied in a slurry state, and no additive was added thereto. In the second recrystallization annealing, the temperature was raised by 15° C. per hour in a mixed atmosphere of 25% nitrogen and 75% hydrogen at a temperature range of up to 1200° C., and a cracking process and a furnace cooling process were performed in an atmosphere of 100% hydrogen at 1200° C. for 15 hours. A forsterite layer formed on the surface of the steel sheet was removed by pickling.

The gloss of the surface measured for each condition is shown in Table 1. The gloss measurement was performed by measuring an amount of light reflected on the surface at an angle of reflection of 60° with a Horiba measuring instrument. When the gloss was less than 20, it was marked to be defective, when the gloss was 20 to 200, it was marked to be excellent, and when the gloss was more than 200, it was marked to be very excellent. The surface roughnesses (Ra) were measured and are listed in Table 1 below.

TABLE 1

| Remarks | In content (wt %) | Gloss | Illumination (Ra: μm) |
|---|---|---|---|
| Comparative Material 1 | 0 | Poor | 0.67 |
| Inventive Material 1 | 0.06 | Very good | 0.097 |
| Inventive Material 2 | 0.1 | Very good | 0.078 |
| Inventive Material 3 | 0.15 | Very good | 0.089 |
| Inventive Material 4 | 0.2 | Very good | 0.066 |
| Inventive Material 5 | 0.24 | Very good | 0.082 |
| Inventive Material 6 | 0.30 | Very good | 0.066 |
| Comparative Material 2 | 0.55 | Rolling crack occurrence | |

As shown in Table 1, the glosses of Inventive Material 1 to Inventive Material 6 containing the appropriate contents of In were excellent, and the surface roughnesses thereof were also excellent with a value of 0.1 μm or less. When a person's face was seen thereon, a very excellent mirror surface was obtained to a degree that the person's face was viewed well.

Example 2

The slab of the grain-oriented electrical steel sheet containing Si at 3.0 wt %, C at 0.051 wt %, Mn at 0.09 wt %, Al at 0.029 wt %, N at 0.0040 wt %, and S at 0.005 wt %, and in which In and Sb are varied as shown in Table 1 below, and containing the remainder including Fe and other impurities unavoidably added thereto, was prepared. The slab was heated at a temperature of 1150° C. for 90 minutes, hot-rolled, quenched to 580° C., annealed at 580° C. for 1 hour, and then hot-rolled to obtain a hot rolled steel sheet having a thickness of 2.3 mm.

The hot-rolled steel sheet was heated at a temperature of 1050° C. or higher, then maintained at 910° C. for 80 seconds, quenched in boiling water, and pickled. Then, it was cold-rolled to have a thickness of 0.30 mm. After the cold-rolled steel sheet was heated, it was maintained at 850□ for 120 seconds in a mixed atmosphere of a dew point temperature of 63 to 67□ formed by simultaneously charging 50 vol % of hydrogen and 50 vol % of nitrogen, and it was subjected to simultaneous decarburization and nitriding, wherein the carbon content was 30 ppm or less and the nitrogen content was 300 ppm.

The steel sheet was subjected to the secondary recrystallization-annealing by applying MgO as an annealing separating agent thereto. MgO was mixed with water and applied in a slurry state, and no additive was added thereto. In the second recrystallization annealing, the temperature was raised by 15° C. per hour in a mixed atmosphere of 25% nitrogen and 75% hydrogen at a temperature range of up to 1200° C., and a cracking process and a furnace cooling process were performed in an atmosphere of 100% hydrogen at 1200° C. for 15 hours. A forsterite layer formed on the surface of the steel sheet was removed by pickling. For the produced steel sheet, iron losses ($W_{17/50}$) until magnetization at 50 Hz and 1.7 Tesla were measured, and are listed in Table 2 below through a single sheet measurement method.

TABLE 2

| Classification | In content (wt %) | Sb content (wt %) | Iron loss ($W_{17/50}$) |
|---|---|---|---|
| Comparative Material 3 | 0 | 0 | 1.05 |
| Inventive Material 7 | 0.005 | 0 | 0.98 |
| Inventive Material 8 | 0.01 | 0 | 0.96 |
| Inventive Material 9 | 0.02 | 0 | 0.93 |
| Inventive Material 10 | 0.038 | 0 | 0.93 |
| Inventive Material 11 | 0.05 | 0 | 0.98 |
| Inventive Material 12 | 0.1 | 0 | 0.99 |
| Comparative Material 4 | 0.55 | 0 | 2.2 |
| Inventive Material 13 | 0.01 | 0.031 | 0.96 |
| Inventive Material 14 | 0.02 | 0.028 | 0.92 |
| Inventive Material 15 | 0.04 | 0.030 | 0.93 |
| Inventive Material 16 | 0.09 | 0.029 | 0.97 |
| Comparative Material 5 | 0.54 | 0.030 | Rolling failure |

As shown in Table 2, it can seen that the glosses of Inventive Material 7 to Inventive Material 12 containing the appropriate contents of In were very excellent, and Inventive Material 13 to Inventive Material 16 further containing Sb in addition to In had the further improved magnetic property.

While the exemplary embodiments of the present invention have been described hereinbefore, it will be understood by those skilled in the art that various changes in form and details may be made thereto without departing from the technical spirit and essential features of the present invention.

Therefore, it is to be understood that the above-described exemplary embodiments are for illustrative purposes only, and the scope of the present invention is not limited thereto. The scope of the present invention is determined not by the above description, but by the following claims, and all changes or modifications from the spirit, scope, and equivalents of claims should be construed as being included in the scope of the present invention.

The invention claimed is:

1. A grain-oriented electrical steel sheet, consisting of:
Si at 1.0 wt % to 7.0 wt %,
C at 0.005 wt % or less (excluding 0 wt %),
In at 0.001 wt % to 0.5 wt %,
Sb at 0.005 wt % to 0.15 wt %,
optionally at least one of Mn, Al, N, S, Sn, P, and Cr, and
the remainder including Fe and other impurities unavoidably added thereto,
wherein a surface roughness (Ra) is 0.1 μm or less.

2. The grain-oriented electrical steel sheet of claim 1, wherein
Mn at 0.005 wt % to 0.9 wt %, Al at 0.01 wt % to 0.1 wt %, N at 0.015 wt % to 0.05 wt %, and S at 0.03 wt % or less (excluding 0 wt %) are included.

3. The grain-oriented electrical steel sheet of claim 1, wherein
Sn at 0.005 wt % to 0.2 wt % is included.

4. The grain-oriented electrical steel sheet of claim 1, wherein
at least one of P at 0.005 wt % to 0.075 wt % and Cr at 0.005 wt % to 0.35 wt is included.

5. The grain-oriented electrical steel sheet of claim 1, wherein
an area ratio of grains having a particle diameter of 1 mm or less is 10% or less.

6. The grain-oriented electrical steel sheet of claim 1, wherein C is present in an amount of 30 ppm or less (excluding 0).

* * * * *